US012214247B2

(12) United States Patent
Epstein et al.

(10) Patent No.: US 12,214,247 B2
(45) Date of Patent: Feb. 4, 2025

(54) FOLDABLE EXERCISE BOARD WITH FOOT ANCHOR

(71) Applicant: STOIK INNOVATIONS, LLC, Dover, DE (US)

(72) Inventors: Ross M. Epstein, Holly Ridge, NC (US); Charles J. Davidson, II, Chicago, IL (US)

(73) Assignee: STOIK Innovations, LLC, Dover, DE (US)

( * ) Notice: Subject to any disclaimer, the term of this patent is extended or adjusted under 35 U.S.C. 154(b) by 22 days.

(21) Appl. No.: 17/845,470

(22) Filed: Jun. 21, 2022

(65) Prior Publication Data

US 2023/0405394 A1 Dec. 21, 2023

(51) Int. Cl.
*A63B 21/00* (2006.01)

(52) U.S. Cl.
CPC ..... *A63B 21/4037* (2015.10); *A63B 2209/00* (2013.01); *A63B 2210/50* (2013.01)

(58) Field of Classification Search
CPC . A63B 21/40; A63B 2209/00; A63B 2210/05; A63B 22/02
See application file for complete search history.

(56) References Cited

U.S. PATENT DOCUMENTS 1,705,745 A * 3/1929 Anderson ..... A63B 21/00047 482/133
1,969,165 A * 8/1934 Turner ..... A63B 21/4015 482/125
3,787,049 A * 1/1974 Rellinger ..... A63B 23/00 482/142
4,116,434 A * 9/1978 Bernstein ..... A63B 21/1645 D21/687
4,176,835 A * 12/1979 Aziz ..... A63B 23/0211 482/140
4,212,458 A * 7/1980 Bizilia ..... A63B 23/0211 482/140
4,241,915 A * 12/1980 Noble ..... A63B 21/00047 482/145
4,509,748 A * 4/1985 Bezak ..... A63B 23/0211 482/140
4,982,958 A 1/1991 Ullman
D319,272 S 8/1991 Rushatz
D330,922 S 11/1992 Novakoski
(Continued)

OTHER PUBLICATIONS

Stoik, Korboard, published on Jan. 6, 2024 [online]. Retrieved from internet (Date: Mar. 20, 2024), https://stoikinnovations.com/ products/ korboard (Year: 2024).

(Continued)

*Primary Examiner* — Garrett K Atkinson

(57) ABSTRACT

A folding exercise board that includes a rear portion, a front portion, and a folding point disposed between the rear portion and the front portion. The folding point includes a locking mechanism. The folding exercise board includes at least one base portion disposed on the front portion. The at least one base portion includes an aperture. The foot anchor is disposed through the aperture of the at least one base portion. The folding exercise board includes a foot anchor, a plurality of hole anchors, and at least one telescoping arm. The at least one telescoping arm is coupled to the foot anchor.

20 Claims, 6 Drawing Sheets

(56) References Cited

U.S. PATENT DOCUMENTS

| | | | | | |
|---|---|---|---|---|---|
| 5,213,558 | A * | 5/1993 | Miller | A63B 23/0211 | 482/904 |
| 5,328,435 | A * | 7/1994 | Ricks | A63B 23/0211 | 482/145 |
| 5,342,274 | A * | 8/1994 | Hunker | A63B 23/0211 | 482/904 |
| 5,372,566 | A * | 12/1994 | Olschansky | A63B 23/0211 | 482/91 |
| 6,135,895 | A * | 10/2000 | Estivo | A63B 69/3661 | 473/278 |
| 6,322,485 | B1 * | 11/2001 | Marrero | A63B 23/0211 | 482/142 |
| 8,715,144 | B1 * | 5/2014 | Friess | A63B 21/4033 | 482/121 |
| 9,259,606 | B2 * | 2/2016 | Wolan | A63B 21/0442 | |
| 9,504,871 | B2 * | 11/2016 | Muñoz Saez | A63B 21/16 | |
| D776,767 | S | 1/2017 | Randleman | | |
| D778,374 | S | 2/2017 | Jaquish | | |
| 9,687,406 | B1 * | 6/2017 | Steiner | A61H 1/0218 | |
| D798,397 | S | 9/2017 | Bellevue | | |
| D890,868 | S | 7/2020 | Zhao | | |
| D960,274 | S | 8/2022 | Moseley | | |
| D973,154 | S | 12/2022 | Huang | | |
| D989,203 | S | 6/2023 | Do | | |
| 11,839,791 | B2 * | 12/2023 | Chapman | A63B 21/0442 | |
| 2002/0077231 | A1 | 6/2002 | Dalebout | | |
| 2005/0026755 | A1 * | 2/2005 | Greene | A63B 21/4045 | 482/121 |
| 2011/0207534 | A1 | 8/2011 | Meldeau | | |
| 2011/0319230 | A1 * | 12/2011 | Brendle | A63B 21/169 | 482/37 |
| 2013/0090216 | A1 * | 4/2013 | Jackson | A63B 21/0442 | 482/52 |
| 2014/0148315 | A1 * | 5/2014 | Thompson | A63B 21/065 | 482/140 |
| 2014/0155232 | A1 * | 6/2014 | Wolan | A63B 21/0442 | 482/123 |
| 2016/0030800 | A1 | 2/2016 | McClure | | |
| 2017/0014681 | A1 * | 1/2017 | Doherty | A63B 23/02 | |
| 2019/0262648 | A1 * | 8/2019 | Swanson | A63B 5/10 | |
| 2019/0299045 | A1 | 10/2019 | Saffaie | | |
| 2020/0282257 | A1 | 9/2020 | Essex | | |
| 2021/0016130 | A1 * | 1/2021 | Cope | A63B 21/4029 | |
| 2021/0106869 | A1 * | 4/2021 | Van Strander | A63B 21/4029 | |
| 2021/0228936 | A1 | 7/2021 | Reed, III | | |
| 2022/0296958 | A1 | 9/2022 | Rupaka | | |
| 2023/0405394 | A1 | 12/2023 | Davidson, II | | |

OTHER PUBLICATIONS

Aerlang, Push up Board Portable Multi-Function, published on Apr. 19, 2023 [online]. Retrieved from internet (Date: Mar. 20, 2024), https://www.amazon.com/AERLANG-Portable-Multi-Function-Foldable-EquipmenUdp/BOC2YT4FYB/?th=1 (Year: 2023).

Coba, Board Body Trainer, published on May 1, 2023 [online]. Retrieved from internet (Date: Mar. 20, 2024), https://www.amazon.com/ COBA-Board-PLUS-Total-Trainer/dp/B0C3Z8YDM6/?th=1 (Year: 2023).

Lalahigh, Ultimate Home Exercise Equipment, published on Dec. 31, 2023 [online]. Retrieved from internet (Date: Mar. 20, 2024), https:// www.amazon.com/Ultimate-Exercise-Equipment-Accessories-Resistance/dp/BOCR8CJ NJU (Year: 2023).

* cited by examiner

FOLDABLE EXERCISE BOARD WITH FOOT ANCHOR

FIELD

The present disclosure relates generally to exercise boards. More specifically, this disclosure relates to a foldable exercise board with foot anchors, telescoping arms, hole anchors, and a locking assembly, to improve stability, versatility, cost, and storage when exercising in small spaces and non-traditional locations.

BACKGROUND

Current exercise regimens require the use of multiple pieces of exercise equipment, as well as an exercise partner, to achieve full-body workouts. This exercise equipment can be costly, complicated, and bulky.

Specifically, a user wanting a full-body workout often have to switch between multiple equipment pieces, each directed at a specific muscle group, physical movement, or set of movements. The user must purchase a number of different pieces of equipment, which is costly and takes up a lot of space. In certain instances, exercise equipment can be complicated, mechanically speaking, and, as a result, they can be both burdensome and time-consuming. For these reasons, the user may be limited as to when and where he or she can complete a desired workout. Additionally, in order to complete certain exercises like abdominal crunches, sit-ups, v-ups, flutter kicks, and the like, the user requires the assistance of an exercise partner (e.g., to hold the user's feet or hands). Similarly, resistance training exercises may require various anchoring points for resistance bands or a variety of weights, bars supporting equipment. As such, the user may be limited as to when and where he or she can complete a desired workout, based on when the user can find an available exercise partner.

Mobile exercise equipment that is inexpensive, simple to operate, and space saving, while enabling a user to exercise without a partner in any location indoors or outdoors, is therefore needed.

SUMMARY

The exercise boards disclosed herein improves on exercise equipment technology by providing a user with versatile and easy-to-store exercise equipment. The exercise board allows the user to work out individually, without a partner, by using the foot anchor, telescoping arms, and multiple hole anchors on the board itself. Additionally, the board is portable and allows the user to easily work out in any desired location (e.g., outdoors, at home, or the like). This exercise board advantageously provides the user with the ability to achieve full-body work outs while minimizing space and cost and maximizing portability, thus increasing the overall ability for the user to complete their exercise regimens.

In light of the disclosure herein, and without limiting the scope of the invention in any way, in a first aspect of the present disclosure, Which may be combined with any other aspect listed herein unless specified otherwise, an exercise board includes a rear portion and a front portion. At least one base portion is disposed on the front portion, the at least one base portion including an aperture. The folding exercise board includes a foot anchor, a plurality of hole anchors, and at least one telescoping arm. The foot anchor is disposed through the aperture of the at least one base portion. The at least one telescoping arm is coupled to the foot anchor.

In a second aspect of the present disclosure, which may be combined with any other aspect listed herein unless specified otherwise, each of the rear portion and front portion are comprised of wood.

In a third aspect of the present disclosure, which may be combined with any other aspect listed herein unless specified otherwise, a sweat-proof and slip-proof material covers a top surface of the rear portion and a top surface of the front portion.

In a fourth aspect of the present disclosure, which may be combined with any other aspect listed herein unless specified otherwise, the sweat-proof and slip-proof material is grip tape.

In a fifth aspect of the present disclosure, which may be combined with any other aspect listed herein unless specified otherwise, the exercise board further includes a folding point disposed between the rear portion and the front portion. The folding point includes a locking mechanism.

In a sixth aspect of the present disclosure, which may be combined with any other aspect listed herein unless specified otherwise, the rear portion and front portion pivot at the folding point from a usage configuration to a storage configuration.

In a seventh aspect of the present disclosure, which may be combined with any other aspect listed herein unless specified otherwise, when in the usage configuration, the top surface of the rear portion and the top surface of the front portion align horizontally so as to form one continuous top surface.

In an eighth aspect of the present disclosure, which may be combined with any other aspect listed herein unless specified otherwise, when in the usage configuration, the locking mechanism prevents the rear portion and front portion from pivoting at the folding point, such that the rear portion and the front portion are only pivotable after the locking mechanism has been disengaged.

In a ninth aspect of the present disclosure, which may be combined with any other aspect listed herein unless specified otherwise, the at least one base portion is coupled near an edge of the front portion. The base portion is of sufficient height to permit a user's foot to pass underneath the foot anchor when the foot anchor is disposed through the aperture of the at least one base portion.

In a tenth aspect of the present disclosure, which may be combined with any other aspect listed herein unless specified otherwise, the at least one telescoping arm is slidably coupled with the foot anchor, such that the at least one telescoping arm is disposed concentrically within the foot anchor at an end of the foot anchor.

In an eleventh aspect of the present disclosure, which may be combined with any other aspect listed herein unless specified otherwise, an end of the at least one telescoping arm includes a clip or loop.

In a twelfth aspect of the present disclosure, which may be combined with any other aspect listed herein unless specified otherwise, each of the plurality of hole anchors includes a hole and an anchor bar running across the hole.

In a thirteenth aspect of the present disclosure, which may be combined with any other aspect listed herein unless specified otherwise, an exercise board includes a rear portion, a front portion, and a folding point disposed between the rear portion and the front portion. The folding point includes a locking mechanism. The folding exercise board further includes a first base portion disposed in a first corner of the front portion, and a second base portion disposed in a second corner of the front portion. Each of the first base portion and the second base portion includes an aperture.

The folding exercise board further includes a foot anchor and at least one telescoping arm. The foot anchor is disposed through the aperture the first base portion and the aperture of the second base portion.

In a fourteenth aspect of the present disclosure, which may be combined with any other aspect listed herein unless specified otherwise, a sweat-proof and slip-proof material covers a top surface of the rear portion and a top surface of the front portion.

In a fifteenth aspect of the present disclosure, which may be combined with any other aspect listed herein unless specified otherwise, the sweat-proof and slip-proof material only covers a first portion of the top surface of the front portion, such that a second portion of the top surface of the front portion remains uncovered.

In a sixteenth aspect of the present disclosure, which may be combined with any other aspect listed herein unless specified otherwise, the second portion of the top surface of the front portion is covered with a wear-resistant material.

In a seventeenth aspect of the present disclosure, which may be combined with any other aspect listed herein unless specified otherwise, the rear portion and front portion pivot at the folding point from a usage configuration to a storage configuration.

In a eighteenth aspect of the present disclosure, which may be combined with any other aspect listed herein unless specified otherwise, when in the usage configuration, the top surface of the rear portion and the top surface of the front portion align horizontally so as to form one continuous top surface.

In a nineteenth aspect of the present disclosure, which may be combined with any other aspect listed herein unless specified otherwise, the first base portion and the second base portion are of sufficient height to permit a user's foot to pass underneath the foot anchor when the foot anchor is disposed through the apertures of the first base portion and the second base portion.

In a twentieth aspect of the present disclosure, which may be combined with any other aspect listed herein unless specified otherwise, the folding exercise board includes a plurality of hole anchors. Each of the plurality of hole anchors includes a hole and an anchor bar running across the hole.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

Figure 1:
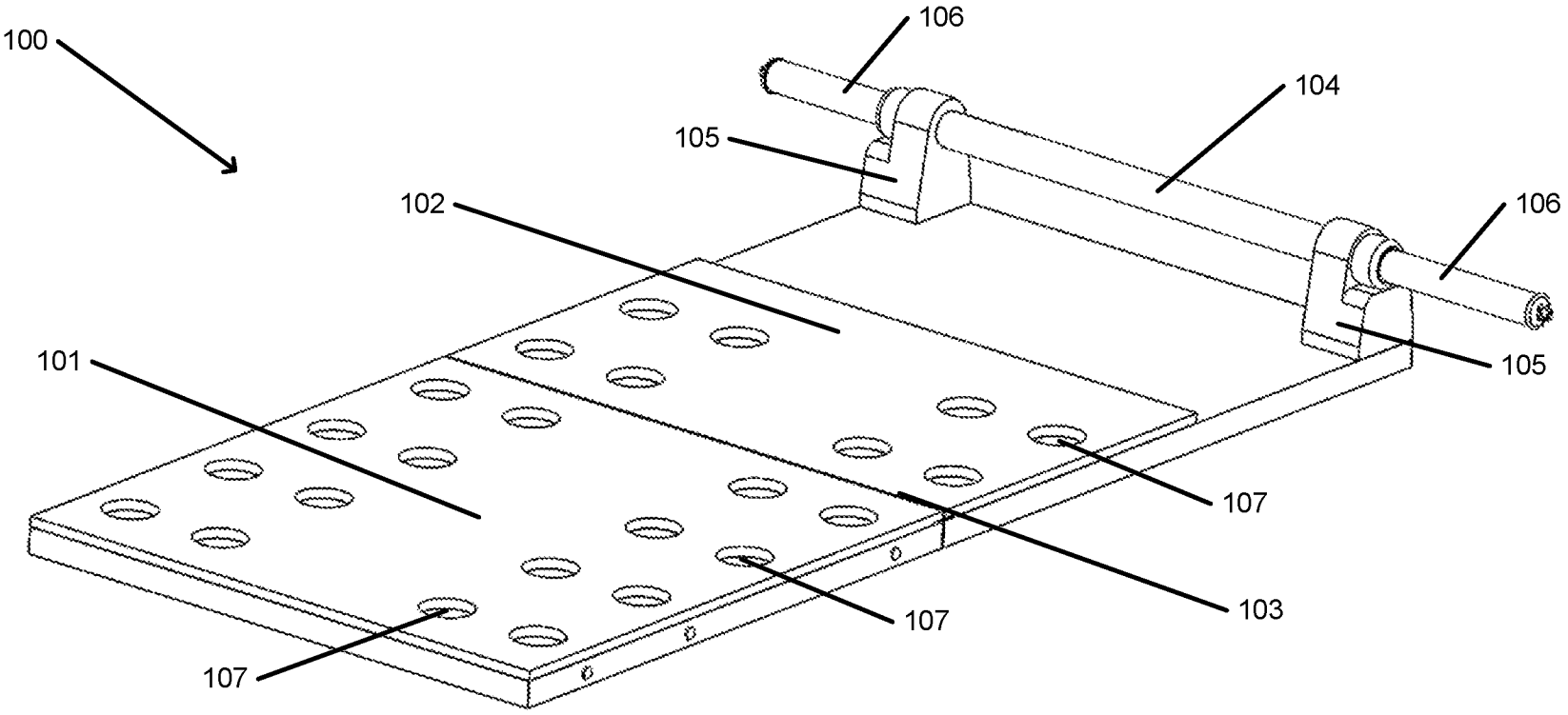
FIG. 1 illustrates a perspective view of an unfolded exercise board with a foot anchor, telescoping arms, and hole anchors, according to an example embodiment of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specific the presence of stated features, integers, steps, operations, elements, and/or components, but do not preclude the presence or additional of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent"). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the Figures, FIG. 1 illustrates an unfolded exercise board with a foot anchor, telescoping arms, and hole anchors, hereinafter referred to as an exercise board 100. Generally, the exercise board 100 includes a rear portion 101 and a front portion 102 each constructed of a lightweight material such as bamboo, another type of wood, or a lightweight polymer. Rear portion 101 and front portion 102 are coupled with each other at a folding point 103. In one embodiment, the rear portion 101 is square-shaped so that its length and width are equivalent, and the front portion 102 is rectangular-shaped, so that its length exceeds its width. Generally, it should be appreciated that the width of the rear portion 101 and front portion 102 are equivalent.

As noted, the rear portion 101 couples with the front portion 102 along a width at the folding point 103. Thus generally, the exercise board 100 has two configurations: engaged and folded. In the engaged configuration, the rear portion 101 lies widthwise next to the front portion 102 along the folding point 103, so as to form one continues flat surface with a length equivalent to the length of the rear portion 101 and the length of the front portion 102. In the folded configuration, the rear portion 101 folds about the folding point 103 so as to lie directly on top of the front portion 102 widthwise, such that an overhang equal to the difference in length between the rear portion 101 and front portion 102 results. In an alternative embodiment, the rear portion 101 and front portion 102 are equal in length, such that when the exercise board 100 is in a folded configuration, there is no overhang.

During an exercise regimen, the user can unfold the exercise board 100 so as to be in the engaged configuration. As such, user can lie along the length of the exercise board 100 or use the continuous, flat surface for any exercise (as described in greater detail herein). Relatedly, when done using the exercise board 100, the user can place the board 100 in the folded configuration for easy transportation and/or storage. By being constructed of a lightweight material, exercise board 100 is easily portable. In an embodiment, the exercise board 100 includes carrying handles (not shown), such that when the board 100 is in a folded configuration, the user can use the carrying handles for transport or storage. It should be appreciated that the location and number of carrying handles can vary. Additionally, in another embodiment, the carrying handles can be removably coupled to the exercise board 100, such that the user can selectively couple and remove them as needed for use, transport, and storage.

The exercise board 100 includes one or more base portions 105 made of plastic and/or metal, a foot anchor 104 made plastic and/or metal, telescoping arms 106 made plastic and/or metal, and hole anchors 107. In an embodiment, as illustrated by FIG. 1, exercise board 100 includes two base portions 105 coupled with the front-most part of the front portion 102. More specifically, the base portions 105 are coupled across from one another, so as to flank the two front-most corners of the front portion 102. In one embodiment, the base portions 105 are fixedly coupled with the front portion 102. In another embodiment, the base portions 105 are removably coupled with the front portion 102, for example by way of a mating relationship or via removable fasteners. Removably-coupled base portions 105 are particularly useful in the previously-described embodiment, whereby the rear portion 101 and front portion 102 are equal lengths. For example, the user can remove the base portions 105 in order to put the exercise board 100 in the flat-folded configuration and re-couple the base portions 105 when putting the board 100 in the engaged configuration.

In one embodiment the foot anchor 104 couples with the base portions 105, so as to be oriented as a horizontal bar between the two base portions 105. Moreover, the foot anchor 104 couples with the base portions 105 at a sufficient vertical height so as to create an area for the user to place his or her feet between the front portion 102 and the foot anchor 104. As such, when the user puts the exercise board 100 in the engaged configuration, he or she can secure their feet with the foot anchor 104 in order to perform exercises like abdominal crunches or sit-ups.

In an alternative embodiment, there is a single base portion 105 coupled with the front portion 102 at the front-most, middle part of front portion 102. In this embodiment, the base portion 105 couples with the middle portion of the foot anchor 104. As such, the foot anchor 104 is held by a single, central base portion 105. In another embodiment, the foot anchor 104 is coupled with three base portions 105, two flanking the front-most corners of the front portion 102 and one in the middle of the front portion 102. It is worth appreciating that there are multiple embodiments with different numbers and configurations of base portions 105, but all allow the user to secure his or her feet in order to perform exercises like abdominal crunches. Once the user has completed their exercise, they can slip their feet out from under the foot anchor 104.

Additionally, while foot anchor 104 as described above is configured for securing one or more of the user's feet to perform certain exercises such as abdominal crunches, it should be appreciated that foot anchor provides additional functionality. Namely, as an example, the user can assume a plank position, with his or her body generally parallel to exercise board 100; in this example, the user can treat foot anchor 104 as a hand-hold. In a related example, the user can do push-ups with his or her hands grasping foot anchor 104.

The exercise board 100 includes hole anchors 107 which are larger perforations throughout the front portion 102 and rear portion 101. The voids formed by these hole anchors 107 reduce the overall weight of the exercise board 100, so as to enable the user to have a sturdy exercise surface that is lightweight and storable. It should be appreciated that the perforation geometries and the specific longitudinal and latitudinal perforation patterns may vary in alternate embodiments. Hole anchors 107 are described in greater detail herein with reference to FIG. 5.

It should be appreciated that the exercise board 100 can have various surface types. For example, in one embodiment, the surface of the rear portion 101 and front portion 102 that faces up when the exercise board 100 is in an engaged configuration, is covered with a rubberized material (e.g., yoga mat). As such, in this embodiment, when in an engaged configuration, the user can comfortably lie on the exercise board 100 to perform exercises. In an alternative embodiment, the rear portion 101 and part of the front portion 102 are covered with a rubberized material and the second part of the front portion 102 is covered with a cross-hatch or anti-slip material. In this embodiment, the user can still lie on the exercise board 100 when it is in the engaged configuration, but they can also stand on the anti-slip portion when performing exercises like squats, without damaging the surface and without the risk of slipping. It should be appreciated that various different materials, such as anti-sweat or varying cushioning foams, can cover the rear portion 101 and front portion 102, and they can do so in varying configurations and/or patterns.

Figure 2:
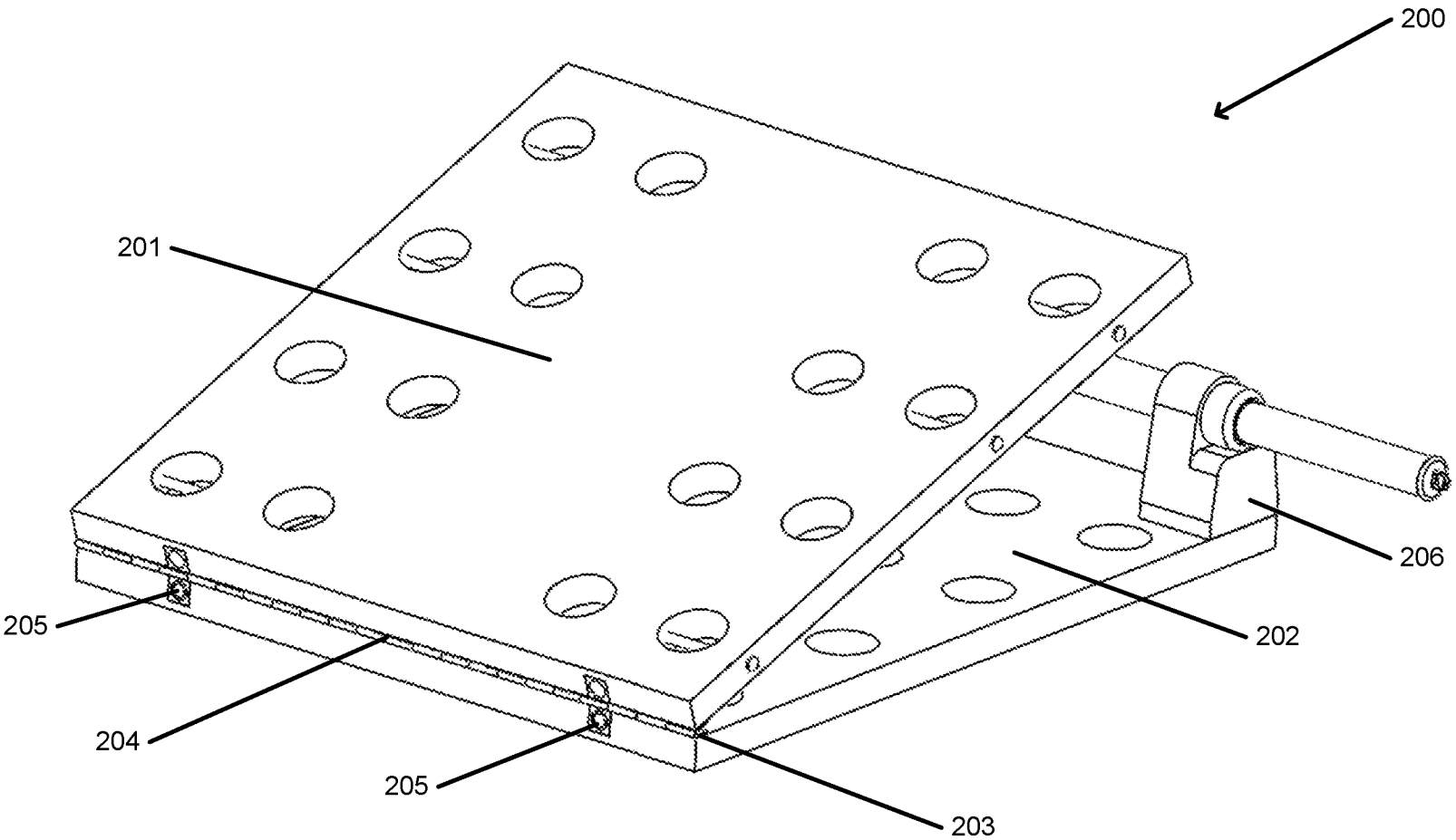
FIG. 2 illustrates a perspective view of a folded exercise board with a foot anchor, telescoping arms, and hole anchors, according to an example embodiment of the present disclosure.

FIG. 2 illustrates an exercise board in a folding configuration. In an embodiment of an exercise board 200, a rear portion 201 and front portion 202 are coupled with one another and move about each other at a folding point 203. More specifically, a hinge 204, such as a piano hinge, couples the rear portion 201 and front portion 202. The hinge 204, allows the user to selectively convert the exercise board 200 between an engaged configuration when they are using the board 200, and a folded configuration when they complete their workout and are storing the board 200. In an alternative embodiment, the hinge 204 consists of multiple hinges instead of a single piano hinge. An yet another embodiment, the hinge 204 consists of different hinge assemblies.

The rear portion 201 and front portion 202 have locking ports 205, located on their respective sides, that meet at the folding point 203. In one embodiment, each portion 201, 202 have two locking ports that each align with one another when the user puts the exercise board 200 in the engaged configuration. As such, when the user puts the exercise board 200 in the engaged configuration, the user can engage with the locking ports 205 so as to lock the exercise board 200 in the engaged configuration. In turn, the user can complete their exercise routine without the risk of the board 200 folding mid-workout, which would disrupt exercise and potentially lead to injury. In additional embodiments, the number and placement of locking ports 205 may vary.

As previously explained, in one embodiment, the front portion 202 is longer than the rear portion 201, so as to create an overhang when the user places the exercise board 200 in a folded configuration. In this embodiment, the overhang's length is equal to at least the length necessary to couple the base portion(s) 206 with the front-most part of the front portion 202. As such, when the user puts the exercise board 200 in a folded configuration, the base portion(s) 206 and rear-most part of the rear portion 201 do not interact so as to prevent the rear portion 201 from lying flat on top of the front portion 202. As also previously explained, in an alternative embodiment, the base portions 206 are removably coupled with the front portion 202, and the front portion 202 is the same size as the rear portion 201. In such an embodiment, when done with a workout, the user de-couples the removable base portions 206 and front portion 202, and then places the exercise board 200 in a folded configuration. When starting a new workout, the user puts the exercise board 200 in an engaged configuration and then couples the removable base portions 206 with the front portion 202.

Figure 3A:
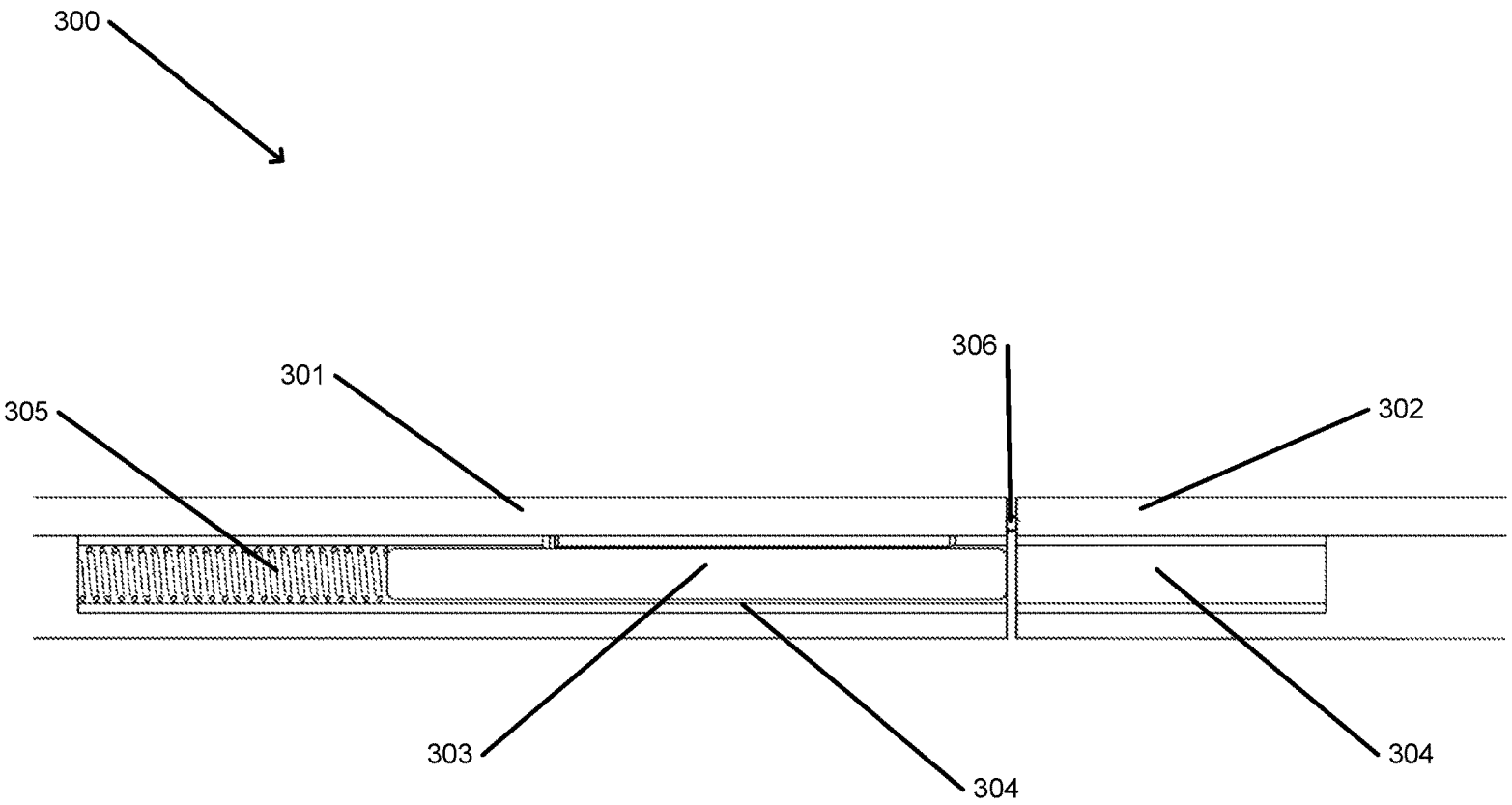
FIGS. 3A-B illustrate an internal view of a locking mechanism in an exercise board, according to an example embodiment of the present disclosure.
Figure 3B:
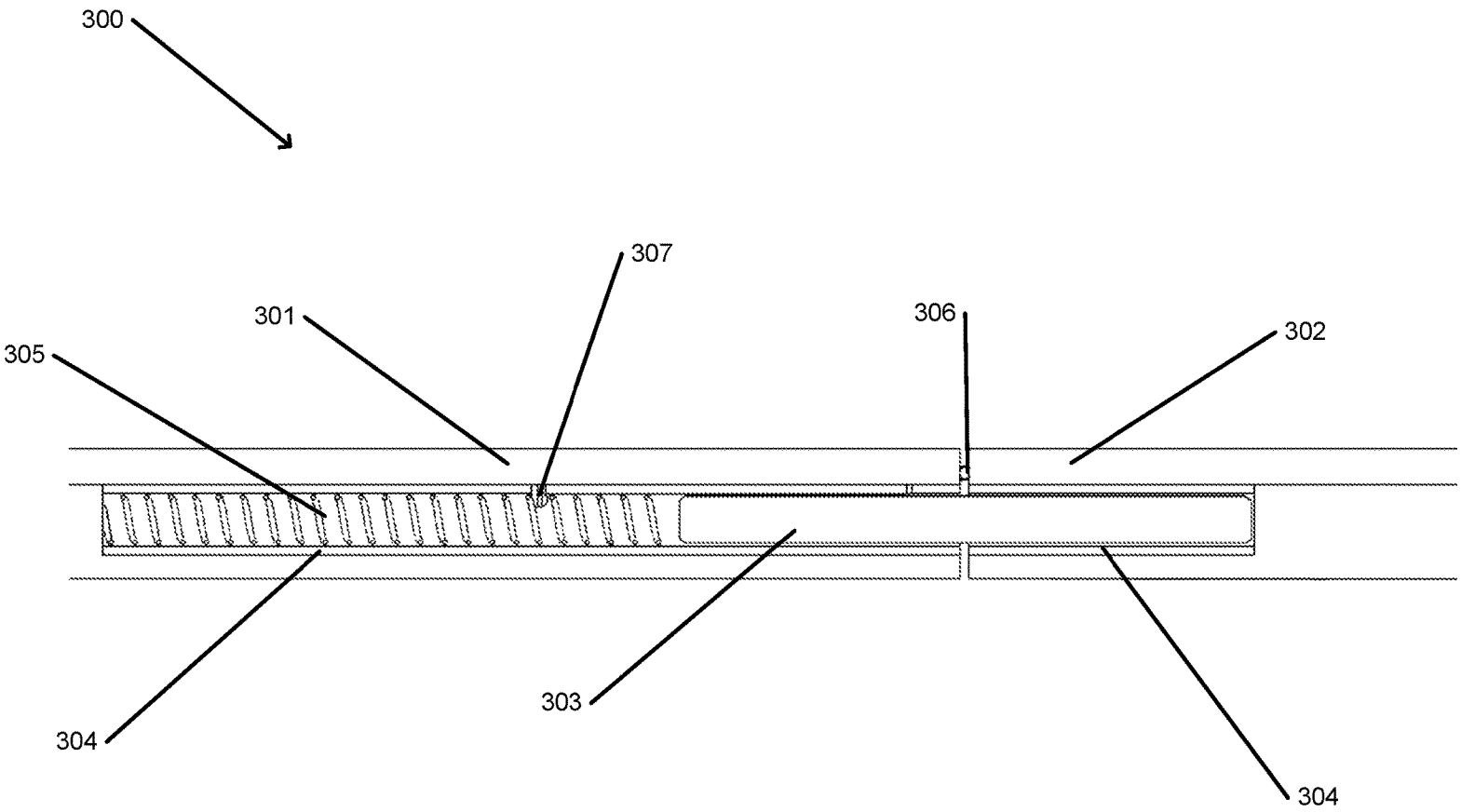

FIGS. 3A-B illustrate an internal view of a locking mechanism in an exercise board. With reference to FIG. 3A, an internal view of a locking mechanism in an exercise board in an unlocked position is shown. In FIG. 3A, a spring 305, made of metal or another flexible material, couples with the inside a locking port 304 in a front portion 301 of an exercise board 300. The spring 305 is coupled to the innermost portion of the locking port 304 on one end, and to a blocking member 303, made metal and/or plastic, on the other end. When the exercise board 300 is in an engaged configuration, the aperture in the locking port 304 on the front portion 301 aligns with an aperture on a locking port 304 on the rear portion 302, thereby creating a plane through which the blocking member 303 can travel. As seen in FIG. 3A, when the exercise board 300 is in an unlocked configuration, the blocking member 303 compresses the spring 305 so as to create tension. The blocking member 303 is secured in the unlocked position by an actuator 307 in FIG. 3B. As such, when the user unlocks the exercise board 300, they can engage with the actuator and/or blocking member 303 so as to compress the spring 306 and secure the blocking member 303 in place. In an alternative embodiment, the blocking member 303 is secured in the unlocked position by a magnetic or electronic assembly. In such an embodiment, the user would engage with a magnetic or electronic assembly in order to secure the blocking member 303 in an unlocked position.

FIG. 3B, an internal view of a locking mechanism in an exercise board in a locked position is shown. In the locked position, user engages with an actuator 307, which in turn releases the previously-secured blocking member 303. The tension from the compressed spring 305 releases to drive the blocking member 303 across the plane created by the locking ports 304. As the blocking member 303 travels across the plane and across the folding point 306, it is partially received by the internal part of the locking port 304 on the rear portion 302, while part of it remains in the front portion 301 locking port 304. The blocking member 303 is secured inside the receiving locking port 304. As a result, in the locked configuration, the blocking member 303 sits within the receiving locking port 304, but also at the folding point 306, so as to prevent the user from moving the exercise board 300 into the folded configuration. In an alternate embodiment, the spring 305 is coupled with the internal part of the locking port 304 in the rear portion 302, and the blocking member 303 is received by the internal part of the locking port 304 in the rear portion 301 of the exercise board 300. In another alternate embodiment, a magnet on the internal part of the receiving locking port 304 further draws the blocking member 303, which is made of metal.

Figure 4:
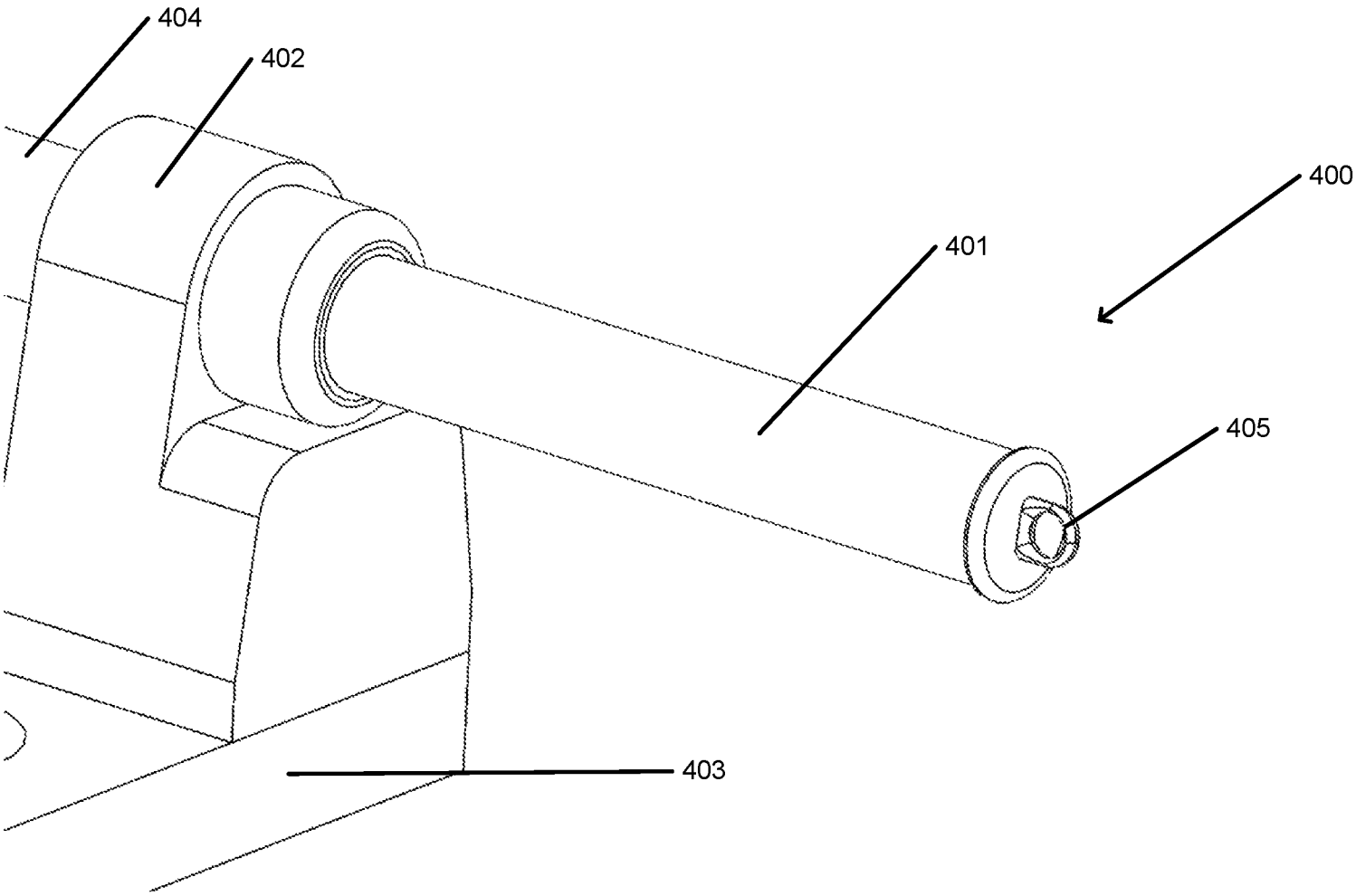
FIG. 4 illustrates a perspective view of a telescoping arm assembly in an exercise board, according to an example embodiment of the present disclosure.

FIG. 4 illustrates a telescoping arm assembly in an exercise board. The assembly includes a base portion 402, a foot anchor 404, a front portion 403, and a telescoping arm 401, and is located on both ends of the foot anchor 404. In this embodiment, the foot anchor 404 couples with the base portion 402, and the telescoping arm 401 slidably couples with the foot anchor 404. In this embodiment, the user can apply force to selectively extend and retract the telescoping arm 401. Additionally, the end of the telescoping arm 401 is coupled with an arm anchor 405, made of metal and/or plastic. The arm anchor 405 is configured to selectively couple with various fastening mechanisms, like carabiners or hooks. As such, when completing a workout, the user can slide out the telescoping arms 401 and hook, for example, an exercise resistance band to the arm anchors 405 in order to complete exercises such as resistance band squats or bicep curls. While arm anchor 405 is illustrated as a closed loop (e.g., for clipping via a carabiner), it should be appreciated that arm anchor 405 may, alternatively, be a hook for direct contact with a resistance band or other rope-like device.

In an alternative embodiment, the telescoping arms 401 also include at least one folding point, such that when the telescoping arms 401 are extended, the user can pivot them about the at least one folding point in order to increase their exercise range of motions. In another embodiment, the telescoping arms 401 include multiple arm anchors 405, such that once the telescoping arms 401 are extended the user can removably couple, for example, carabiners or hooks at multiple points of the telescoping arm. In another embodiment, the telescoping arm 301 extends to and locks at multiple, pre-determined lengths. As such, the user is not limited to fully extending the telescoping arm 401 if they need to use it. Rather, the user can extend the telescoping arm 301 at a shorter extension length.

Figure 5:
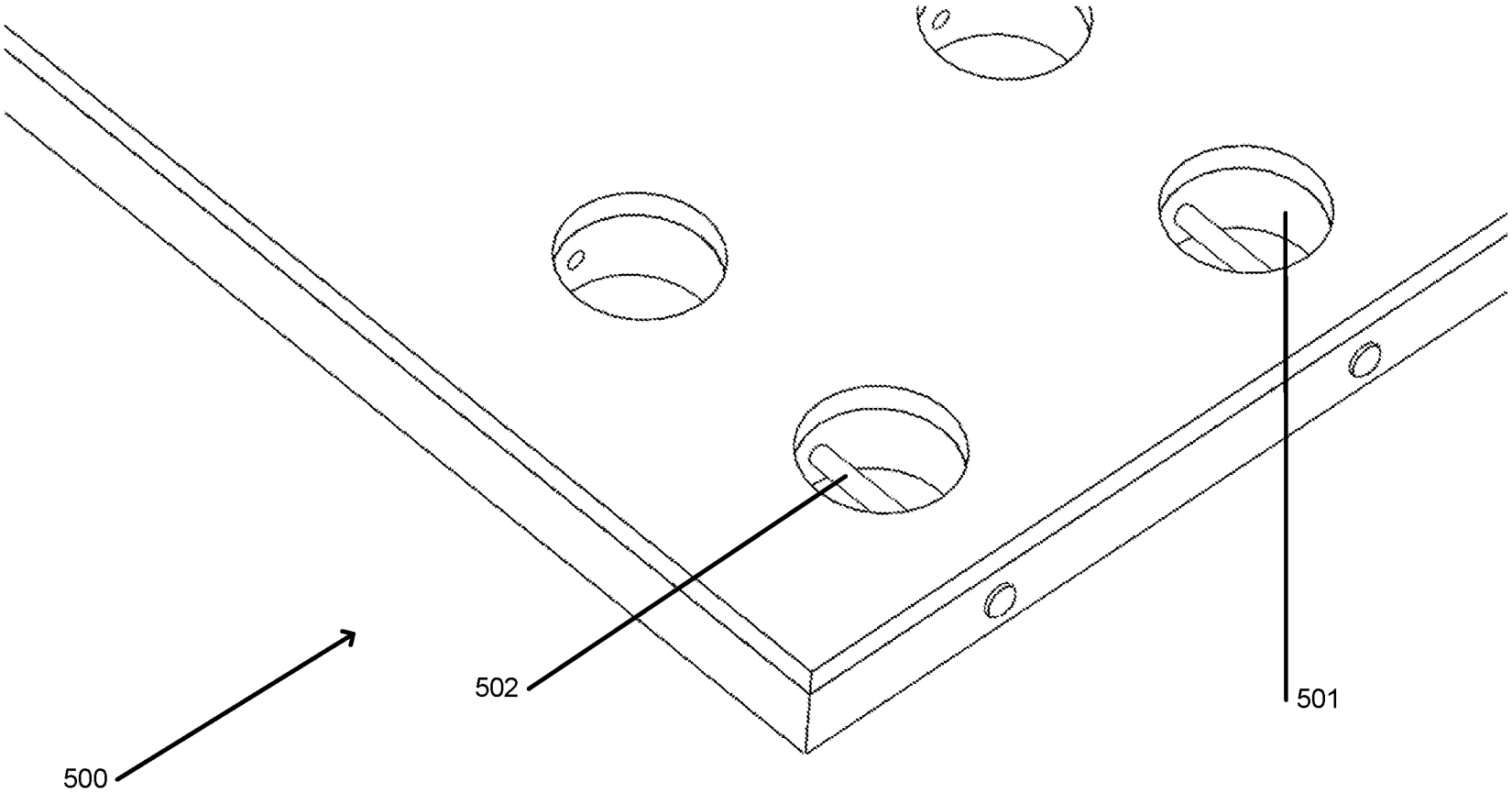
FIG. 5 illustrates a perspective view of a hole anchor assembly in an exercise board, according to an example embodiment of the present disclosure.

FIG. 5 illustrates a hole anchor assembly in an exercise board. In this embodiment, an exercise board 500 includes hole anchor assemblies that are comprised of hole anchors 501 and anchor bars 502. The hole anchors 501 are located throughout the surface of the exercise board 500. The hole anchors 501 are perforations that can be made, for example, by drilling the exercise board 500, or by being casted and molded if the exercise board 500 is made of a malleable material, like a plastic. Anchor bars 502, made of metal and/or plastic, couple with the inside of the hole anchors 501, so as to form, for example, a "bar" running from one end of the hole anchor 501 to the other end. The user can, for example, couple carabiners or other similar fasteners, to the anchor bars 502 in order to removably couple exercise bands, or other exercise accessories, to the exercise board 500. Alternatively, the user could loop a resistance band or other rope-like device under and around the anchor bar 502 to removably couple it to the exercise board.

It should be appreciated that hole anchors 501 may be disposed as an array or pattern along exercise board 500. Various hole anchor locations enable the user to precisely generate resistance force vectors (e.g. via resistance bands coupled to anchor bars 502 as described above) suitable for multiple exercises and accommodating a wide range of both user-height and user-weight. For example, the user can lie on his or her back, while applying resistance across the user's hips via a resistance band attached to hole anchors 501 at the user's hip position on exercise board 500; the user may perform a resistance hip thrust by thrusting his or her hips normal to exercise board 500. Various hole anchor locations offer options for creating customized torque on the body, by varying the lever arm locations and force vector geometry on a user-by-user basis.

As such, the user is not limited to only coupling exercise accessories with arm anchors 405 (discussed with reference to FIG. 4), but rather can couple exercise accessories with hole anchors 501 throughout the entirety of the exercise board 500 surface. The user can therefore have more versatility as to the types of exercises they perform on the exercise board 500, including customization of the resistance forces applied to the body via discrete locations along exercise board 500. In another embodiment, the anchor bars 502 are in the shape of screw hook, or a loop, to which the user can removably couple carabiners or other similar fasteners. It should be appreciated that the hole anchor 501 perforation geometries and the specific longitudinal and latitudinal perforation patterns may vary in alternate embodiments.

Generally, the exercise boards disclosed herein provide for a number of improvements over existing exercise technology, by implementing lightweight and portable boards that can be easily transported to/from a workout location. The exercise boards herein allow the user to perform a number of varied body-weight exercises, including sit-ups, push-ups, planks, and squats. Furthermore, the additional features of these exercise boards allow the user to perform advanced exercises with resistance bands. The exercise boards herein provide these benefits within a self-contained system, requiring no additional setup for maximum convenience to the user.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An exercise board comprising:

a board member having a thickness and defining a longitudinal axis of the exercise board;

at least one base member coupled to a top surface of the board member, the at least one base member extending outward from the top surface the at least one base member defining an aperture at a separation distance from the top surface;

a bar member positioned orthogonal to the longitudinal axis and extending through the aperture defined by the at least one base member at the separation distance from the top surface; and at least one hole anchor assembly, the at least one hole anchor assembly including a through hole defined by the board member and an anchor bar disposed across the through hole, the through hole extending through the thickness of the board member.

2. The exercise board of claim 1, wherein:

a sweat-proof and slip-proof material covers a portion of the top surface.

3. The exercise board of claim 2, wherein;

the sweat-proof and slip-proof material is grip tape.

4. The exercise board of claim 1, wherein:

the board member includes a first portion and a second portion;

the second portion is coupled to the first portion via a folding point disposed between the first portion and the second portion; and the folding point includes a locking mechanism.

5. The exercise board of claim 4, wherein;

the first portion and second portion are movable about the folding point between a usage configuration and storage configuration of the exercise board.

6. The exercise board of claim 5, wherein;

on a condition that the exercise board is in the usage configuration, a top surface of the first portion and a top surface of the second portion are horizontally aligned so as to form one continuous top surface of the exercise board.

7. The exercise board of claim 6, wherein;

on a condition that the exercise board is in the usage configuration, the locking mechanism prevents the first portion and second portion from pivoting at the folding point, such that the first portion and the second portion are only pivotable after the locking mechanism has been disengaged.

8. The exercise board of claim 1, wherein:

the bar member is configured as a foot anchor; and the separation distance has a magnitude that is sufficient to permit a user's foot to pass between the foot anchor and the top surface.

9. The exercise board of claim 1, further comprising:

at least one telescoping arm;

the at least one telescoping arm is slidably coupled with the bar member; and the at least one telescoping arm is disposed concentrically within the bar member.

10. The exercise board of claim 9, wherein:

an end of the at least one telescoping arm includes a clip or loop positioned to secure an exercise band.

11. The exercise board of claim 1, wherein;

the at least one hole anchor assembly is one of a plurality of hole anchor assemblies; and the hole anchor assemblies of the plurality of hole anchor assemblies are distributed as an array along the exercise board.

12. The exercise board of claim 1, wherein:

the at least one hole anchor assembly is one of a first plurality of hole anchor assemblies;

the exercise board further comprises a second plurality of hole anchor assemblies;

the first plurality of hole anchor assemblies extending parallel to the longitudinal axis along a first lateral side of the board member; and the second plurality of hole anchor assemblies extending parallel to the longitudinal axis along a second lateral side of the board member.

13. An exercise board comprising:

a first portion;

a second portion, the first portion and the second portion defining a longitudinal axis of the exercise board;

a folding point disposed between the first portion and the second portion;

a locking mechanism positioned to selectively restrict a movement of the second portion relative to the first portion about the folding point;

at least one base member coupled to a top surface of the second portion, the at least one base member extending outward from the top surface, the at least one base member defining an aperture at a separation distance from the top surface;

a bar member positioned orthogonal to the longitudinal axis and extending through the aperture defined by the at least one base member at the separation distance from top surface; and at least one hole anchor assembly, the at least one hole anchor assembly including a through hole defined by one of the first portion or the second portion and an anchor bar bisecting the through hole.

14. The exercise board of claim 13, wherein:

a sweat-proof and slip-proof material covers a top surface of the first portion and a top surface of the second portion.

15. The exercise board of claim 14, wherein;

the sweat-proof and slip-proof material covers a first portion of the top surface of the second portion; and a second portion of the top surface of the second front portion has an absence of the sweat-proof and slip-proof material.

16. The exercise board of claim 15, wherein:

the second portion of the top surface of the second portion is covered with a wear-resistant material.

17. The exercise board of claim 13, wherein:

the first portion and second portion are movable about the folding point between a usage configuration and a storage configuration of the exercise board.

18. The exercise board of claim 17, wherein;

on a condition that the exercise board is in the usage configuration, a top surface of the first portion and the top surface of the second portion are horizontally aligned so as to form one continuous top surface of the exercise board.

19. The exercise board of claim 13, wherein:

the bar member is configured as a foot anchor; and the separation distance has a magnitude that is sufficient to permit a user's foot to pass between the foot anchor and the top surface.

20. The exercise board of claim 13, wherein:

the at least one hole anchor assembly is one of a plurality of hole anchor assemblies; and the hole anchor assemblies of the plurality of hole anchor assemblies are distributed as an array along both the first portion and the second portion.

* * * * *